US007208232B1

(12) United States Patent
Gorman et al.

(10) Patent No.: US 7,208,232 B1
(45) Date of Patent: Apr. 24, 2007

(54) STRUCTURAL ENVIRONMENTALLY-PROTECTIVE COATING

(75) Inventors: Mark Daniel Gorman, West Chester, OH (US); Ramgopal Darolia, West Chester, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/164,564

(22) Filed: Nov. 29, 2005

(51) Int. Cl.
*B32B 15/01* (2006.01)
*B32B 15/04* (2006.01)
*B32B 15/18* (2006.01)

(52) U.S. Cl. ..... 428/670; 428/220; 428/332; 428/335; 428/680; 428/681; 416/241 R

(58) Field of Classification Search ..... 428/670, 428/669, 678, 679, 680, 681, 632, 633, 220, 428/215, 334, 335, 332; 416/241 R
See application file for complete search history.

(56) References Cited

U.S. PATENT DOCUMENTS 5,427,866 A 6/1995 Nagaraj et al. ..... 428/610
6,153,313 A 11/2000 Rigney et al. ..... 428/632
6,609,894 B2 8/2003 Jackson et al. ..... 416/224
6,682,827 B2 1/2004 Darolia et al. ..... 428/632
6,720,034 B2 4/2004 Skoog et al. ..... 427/419.1
2003/0049156 A1* 3/2003 Jackson et al. ..... 420/462
2004/0142204 A1* 7/2004 Zhao et al. ..... 428/633

* cited by examiner

*Primary Examiner*—Michael E. LaVilla
(74) *Attorney, Agent, or Firm*—David L. Narciso; Gary M. Hartman; Domenica N. S. Hartman

(57) ABSTRACT

A coating suitable for use as an environmentally-protective coating on surfaces of components used in hostile thermal environments, including the turbine, combustor and augmentor sections of a gas turbine engine. The coating is used in a coating system deposited on a substrate formed of a superalloy material. The coating contacts a surface of the superalloy substrate and is formed of a coating material having a tensile strength of more than 50% of the superalloy material. The coating material is predominantly at least one metal chosen from the group consisting of platinum, rhodium, palladium, and iridium, and has sufficient strength to significantly contribute to the strength of the component on which the coating is deposited.

20 Claims, 1 Drawing Sheet

STRUCTURAL ENVIRONMENTALLY-PROTECTIVE COATING

BACKGROUND OF THE INVENTION

This invention relates to coatings of the type used to protect components exposed to high temperature environments, such as the hostile thermal environment of a gas turbine engine. More particularly, this invention is directed to protective coatings that are capable of significantly contributing to the structural properties of the components they protect.

Certain components of the turbine, combustor and augmentor sections susceptible to damage by oxidation and hot corrosion attack are typically protected by an environmental coating and optionally a thermal barrier coating (TBC), in which case the environmental coating is termed a bond coat that in combination with the TBC forms what may be termed a TBC system. Environmental coatings and TBC bond coats are often formed of an oxidation-resistant aluminum-containing alloy or intermetallic whose aluminum content provides for the slow growth of a strong adherent continuous aluminum oxide layer (alumina scale) at elevated temperatures. This thermally grown oxide (TGO) provides protection from oxidation and hot corrosion, and in the case of a bond coat promotes a chemical bond with the TBC. However, a thermal expansion mismatch exists between metallic bond coats, their alumina scale and the overlying ceramic TBC, and peeling stresses generated by this mismatch gradually increase over time to the point where TBC spallation can occur as a result of cracks that form at the interface between the bond coat and alumina scale or the interface between the alumina scale and TBC. More particularly, coating system performance and life have been determined to be dependent on factors that include stresses arising from the growth of the TGO on the bond coat, stresses due to the thermal expansion mismatch between the ceramic TBC and the metallic bond coat, the fracture resistance of the TGO interface (affected by segregation of impurities, roughness, oxide type and others), and time-dependent and time-independent plastic deformation of the bond coat that leads to rumpling of the bond coat/TGO interface. As such, advancements in TBC coating system have been concerned in part with delaying the first instance of oxide spallation, which in turn is influenced by the above strength-related factors.

Environmental coatings and TBC bond coats in wide use include alloys such as MCrAlX overlay coatings (where M is iron, cobalt and/or nickel, and X is yttrium or another rare earth element), and diffusion coatings that contain aluminum intermetallics, predominantly beta-phase nickel aluminide and platinum-modified nickel aluminides (PtAl). In contrast to the aforementioned MCrAlX overlay coatings, which are metallic solid solutions containing intermetallic phases, the NiAl beta phase is an intermetallic compound present within nickel-aluminum compositions containing about 25 to about 60 atomic percent aluminum. Because TBC life depends not only on the environmental resistance but also the strength of its bond coat, bond coats capable of exhibiting higher strength have been developed, notable examples of which include beta-phase NiAl overlay coatings (as opposed to diffusion coatings) disclosed in commonly-assigned U.S. Pat. No. 5,975,852 to Nagaraj et al., U.S. Pat. No. 6,153,313 to Rigney et al., U.S. Pat. No. 6,255,001 to Darolia, U.S. Pat. No. 6,291,084 to Darolia et al., U.S. Pat. No. 6,620,524 to Pfaendtner et al., and U.S. Pat. No. 6,682,827 to Darolia et al. These intermetallic overlay coatings, which preferably contain a reactive element (such as zirconium and/or hafnium) and/or other alloying constituents (such as chromium), have been shown to improve the adhesion and spallation resistance of a ceramic TBC. The presence of reactive elements such as zirconium and hafnium in beta-phase NiAl overlay coatings has been shown to improve environmental resistance as well as strengthen the coating, primarily by solid solution strengthening of the beta-phase NiAl matrix.

In addition to the above, the suitability of environmental coatings and TBC bond coats formed of NiAlPt to contain both gamma phase (γ-Ni) and gamma-prime phase (γ'-$Ni_3Al$) is reported in U.S. Patent Application Publication No. 2004/0229075 to Gleeson et al. The NiAlPt compositions evaluated by Gleeson et al. contained less than about 23 atomic percent (about 9 weight percent or less) aluminum, between about 10 and 30 atomic percent (about 28 to 63 weight percent) platinum, and optionally limited additions of reactive elements.

Aside from use as additives in MCrAlX overlay coatings and diffusion coatings, and as major constituents in intermetallic overlay coatings such as Gleeson et al., platinum and other platinum group metals (PGM) such as rhodium and palladium have been considered as a replacement for traditional bond coats. For example, commonly-assigned U.S. Pat. No. 5,427,866 to Nagaraj et al. discloses deposition of a thin protective layer (up to about 0.001 inch (about 25 micrometers)) of platinum, rhodium, or palladium on a substrate, diffusing at least a portion of the protective layer into the substrate, and then depositing a ceramic layer directly on the diffused protective layer. According to Nagaraj et al., elimination of a traditional bond coat reduces the weight of the coated article and reduces the likelihood of a detrimental secondary reaction zone (SRZ) forming in the substrate surface.

Though having the above-noted benefits, there are drawbacks to the use of environmental coatings and bond coats. For example, the maximum design temperature of a coated component is typically limited by the maximum allowable temperature of its environmental coating or bond coat (in the event of TBC spallation). A low melting point zone also tends to form between such coatings and their underlying superalloy substrate, further limiting the high temperature capability of the component. Another drawback is that the materials used to form environmental coatings and bond coats are relatively weak compared to the nickel and cobalt-base superalloys that form the components they protect. As a result, these coatings are considered dead weight that must be supported by the superalloy substrate, which is particularly detrimental to rotating airfoil applications such as turbine blades where the effect is greatly multiplied by the high G-field under which such components operate. As a result, airfoil components must be designed to be sufficiently strong to carry the weight of the coatings, often incurring yet additional weight penalty.

In view of the above, even with the existing advancements in materials and processes for environmental coatings and bond coats, there is a considerable ongoing effort to develop improved environmental coatings and TBC systems.

BRIEF SUMMARY OF THE INVENTION

The present invention generally provides a coating suitable for use as an environmentally-protective coating on surfaces of components used in hostile thermal environments, including the turbine, combustor and augmentor sections of a gas turbine engine. Such coatings include environmental coatings that form the outmost surface of a component, and bond coats that adhere a TBC to the component. The invention is particularly directed to coatings with sufficient strength, as measured in terms of tensile or rupture strength, to enable the coating to contribute to the strength of the component on which the coating is deposited.

According to the invention, the coating is used in a coating system deposited on a substrate formed of a superalloy material. The coating is on and contacts a surface of the superalloy substrate and is formed of a coating material having a tensile strength of more than 50% of the superalloy material at temperatures corresponding to the maximum operating temperature of the superalloy substrate, such as in a range of about 900° C. to about 1150° C. According to the invention, the coating material is predominantly at least one metal chosen from the group consisting of platinum, rhodium, palladium, and iridium. The coating material preferably also contains elements capable of further strengthening the coating, as well as elements capable of increasing the environmental resistance and thermal (diffusional) stability of the coating.

The coating of this invention has desirable environmental and mechanical properties that render it useful as an environmental coating and as a bond coat for a TBC. In particular, as a result of being predominantly platinum, rhodium, palladium, and/or iridium, the coating exhibits greater oxidation resistance than the superalloy substrate it protects. In contrast to conventional environmental coatings and bond coats, the coating also exhibits sufficient strength so that, for example, the combination of the superalloy substrate and coating may exhibit a combined strength of at least 90% of the strength that would exist if the combined thickness of the coating and substrate were formed entirely by the superalloy of the substrate. The strength of the coating can be further promoted with additions of one or more transition elements (particularly zirconium, hafnium, titanium, tantalum, niobium, chromium, tungsten, molybdenum, rhenium, and/or ruthenium). In addition, the environmental resistance and thermal (diffusional) stability of the coating can be promoted with additions of aluminum, chromium, and/or nickel.

Other objects and advantages of this invention will be better appreciated from the following detailed description.

DETAILED DESCRIPTION OF THE INVENTION

Figure 1:
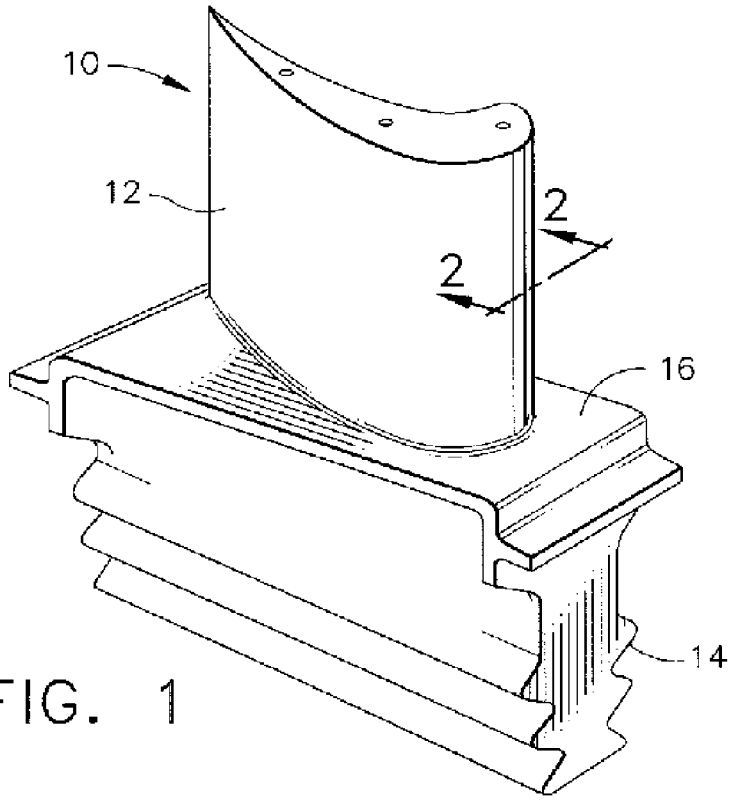
FIG. 1 is a perspective view of a high pressure turbine blade.

The present invention is generally applicable to components that operate within environments characterized by relatively high temperatures, and are therefore subjected to severe thermal stresses and thermal cycling. Notable examples of such components include the high and low pressure turbine nozzles and blades, shrouds, combustor liners and augmentor hardware of gas turbine engines. Of particular interest are components that must withstand high g-forces, such as rotating airfoil components of gas turbine engines. One such example is a high pressure turbine blade 10 shown in FIG. 1. The blade 10 includes an airfoil 12 against which hot combustion gases are directed during operation of the gas turbine engine. The airfoil 12 is hollow to permit the flow of cooling air through passages within the blade 10, with the result that the exterior of the airfoil 12 is generally defined by walls whose outer surfaces are subjected to severe attack by oxidation, corrosion, and erosion and whose inner surfaces are contacted by the cooling air flow. The airfoil 12 is anchored to a turbine disk (not shown) with a dovetail 14 formed on a root section 16 of the blade 10. While the advantages of this invention will be described with reference to the high pressure turbine blade 10 shown in FIG. 1, the teachings of this invention are generally applicable to any component on which a coating system may be used to protect the component from its environment.

Figure 2:
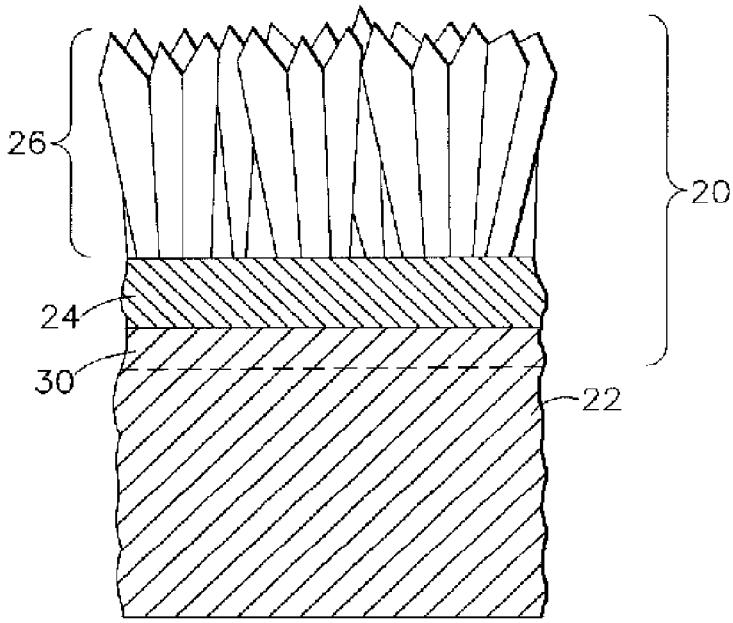
FIG. 2 is a cross-sectional view of the blade of FIG. 1 along line 2—2, and shows a thermal barrier coating system on the blade in accordance with an embodiment of this invention.

FIG. 2 schematically depicts a TBC system 20 of a type within the scope of this invention. As shown, the coating system 20 includes a ceramic layer, or thermal barrier coating (TBC), 26 bonded to an outer wall 22 of the blade 10 with a metallic coating 24, which therefore serves as a bond coat to the TBC 26, though it is within the scope of the invention to omit a TBC and use the coating 24 as an environmental coating. The blade 10, and therefore also its wall 22, is preferably formed of a superalloy, such as a nickel-base superalloy, though it is foreseeable that the wall 22 could be formed of another superalloy material. Generally, in applications such as the blade 10, suitable superalloys exhibit tensile strengths of at least 350 MPa and 100-hour rupture strengths of at least 100 MPa at the maximum operating temperature of the turbine blade 10, e.g., about 1100° C. or more.

To attain the strain-tolerant columnar grain structure depicted in FIG. 2, the TBC 26 is deposited by physical vapor deposition (PVD), such as electron beam physical vapor deposition (EBPVD), though other deposition techniques could be used including thermal spray processes that yield a noncolumnar grain structure. A preferred material for the TBC 26 is yttria-stabilized zirconia (YSZ), with a suitable composition being about 3 to about 20 weight percent yttria (3–20% YSZ), though other ceramic materials could be used, such as yttria, nonstabilized zirconia, and zirconia stabilized by other oxides. Notable alternative materials for the TBC 26 include those formulated to have lower coefficients of thermal conductivity (low-k) than 7% YSZ, notable examples of which are disclosed in commonly-assigned U.S. Pat. No. 6,586,115 to Rigney et al., U.S. Pat. No. 6,686,060 to Bruce et al., U.S. Pat. No. 6,808,799 to Darolia et al., and U.S. Pat. No. 6,890,668 to Bruce et al., commonly-assigned U.S. patent application Ser. No. 10/063,962 to Bruce, and U.S. Pat. No. 6,025,078 to Rickerby. Still other suitable ceramic materials for the TBC 26 include those that resist spallation from contamination by compounds such as CMAS (a eutectic of calcia, magnesia, alumina and silica). For example, the TBC can be formed of a material capable of interacting with molten CMAS to form a compound with a melting temperature that is significantly higher than CMAS, so that the reaction product of CMAS and the material does not melt and infiltrate the TBC. Examples of CMAS-resistant coatings include alumina, alumina-containing YSZ, and hafnia-based ceramics disclosed in commonly-assigned U.S. Pat. Nos. 5,660,885, 5,683,825, 5,871,820, 5,914,189, 6,627,323, 6,720,038, and 6,890,668, whose disclosures regarding CMAS-resistant coating materials are incorporated herein by reference. Other potential ceramic materials for the TBC include those formulated to have erosion and/or impact resistance better than 7% YSZ. Examples of such materials include certain of the above-noted CMAS-resistant materials, particularly alumina as reported in U.S. Pat. Nos. 5,683,825 and 6,720,038. Other erosion and impact-resistant compositions include reduced-porosity YSZ as disclosed in commonly-assigned U.S. patent application Ser. Nos. 10/707,197 and 10/708,020, fully stabilized zirconia (e.g., more than 17% YSZ) as disclosed in commonly-assigned U.S. patent application Ser. No. 10/708,020, and chemically-modified zirconia-based ceramics. The TBC 26 is deposited to a thickness that is sufficient to provide the required thermal protection for the underlying wall 22 and blade 10, generally on the order of about 100 to about 300 micrometers.

As with prior art TBC systems, an important role of the coating 24 is to environmentally protect the airfoil wall 22 when exposed to the oxidizing environment within a gas turbine engine. A function of conventional bond coats has been to provide a reservoir of aluminum from which an aluminum oxide surface layer (alumina scale) grows to promote adhesion of the TBC. In contrast, if the coating 24 of this invention contains aluminum at all, it is present at minor alloying levels to modify the diffusion and oxidation behavior of the coating (and possibly but not necessarily form an alumina scale on the coating 24). Instead, the coating 24 is predominantly platinum, rhodium, palladium, and/or iridium. The coating 24 may further contain limited alloying additions to further promote the strength of the coating 24 and/or increase the environmental resistance and thermal (diffusional) stability of the coating 24. In particular, the strength of the coating 24 can be promoted with additions of solid solution strengtheners such as chromium, tungsten, molybdenum, rhenium and/or ruthenium, and/or with precipitation strengtheners such as zirconium, hafnium, tantalum, titanium, and niobium. Finally, chromium, aluminum, and/or nickel can be added to the coating 24 to promote environmental resistance and thermal (diffusional) stability.

According to a preferred aspect of the invention, the coating 24 contains, by weight, at least 60% of platinum, rhodium, palladium, iridium, or a combination thereof, optionally not more than 20% of nickel and chromium combined, optionally not more than 15% aluminum, optionally not more than 10% of other alloying constituents in combination, and incidental impurities. If present, preferred amounts for the optional constituents are, by weight, at least 5% nickel and chromium combined, at least 2% aluminum, and at least 2% of other alloying constituents in combination. Particularly suitable alloys for the coating 24 are believed to contain rhodium, zirconium, and at least one of platinum, ruthenium, and palladium. Because of the excellent oxidation and corrosion resistance of its predominant platinum group metal (PGM) constituent(s), the coating 24 tends to grow very little oxide scale on its outer surface (as represented in FIG. 2), in contrast to conventional environmental coating and bond coat materials. Instead, any thermally grown oxide (TGO) scale is generally attributable to minor alloying constituents that may be present in the coating 24, most notably aluminum, chromium, and nickel. With the absence of a relatively thick oxide scale that continues to grow throughout the life of the blade 10, the present invention avoids the tendency for spallation of the TBC 26 to occur from cracking and spallation of oxide scale attributable to thermal expansion mismatches within the TBC system 20.

According to an important aspect of the invention, in addition to oxidation resistance, the coating 24 with preferred compositions within the above-noted ranges are characterized by strengths (tensile and/or rupture) of greater than 50% of that of the superalloy of the underlying wall 22 at temperatures to which the blade 10 is exposed (e.g., about 900° C. to about 1150° C.), and preferably at temperatures at which the mechanical properties of many superalloys tend to notably decline, such as 1000° C. and above. As an example, a coating 24 formed of a rhodium-palladium-platinum alloy containing about 60 weight percent rhodium, about 25 weight percent palladium, about 10 weight percent platinum, and about 3 weight percent zirconium are capable of tensile strengths of 160 MPa and higher at about 1200° C. As another example, a coating 24 formed of a rhodium alloy containing about 91 weight percent rhodium, about 2 weight percent ruthenium, and about 7 weight percent zirconium is capable of tensile strengths of 260 MPa and higher at about 1200° C. In contrast, such traditional environmental coatings and bond coats as diffusion aluminides (nickel and platinum-modified nickel aluminides), MCrAlX overlays, and NiAl overlays have tensile strengths that typically do not exceed about 30 MPa, 20 MPa, and 70 MPa, respectively, at about 1100° C., and are therefore generally on the order of not more than about 20% of superalloys typically used to form rotating gas turbine engine components such as the blade 10 of FIG. 1. As a result, while rotating turbine components such as the blade 10 have traditionally been designed to have sufficient strength to carry and support environmental coatings and bond coats without any structural contribution from these coatings, the present coating 24 is preferably capable of structurally contributing to the strength of the blade 10.

Depending on its particular composition, the coating 24 can be deposited using various deposition processes, with or without a subsequent heat treatment. For example, the coating 24 can be deposited using a plating technique, ion plasma deposition, or thermal spraying. To relieve stresses in the coating 24, deposition can be followed by a heat treatment at temperatures of about 1000° C. to about 1200° C. for about one to about four hours. A suitable minimum thickness for the coating 24 is about 10 micrometers in order to provide an adequate level of environmental protection to the underlying wall 22. Thicknesses of at least 25 micrometers and more particularly about 35 up to about 125 micrometers are believed to be preferred for turbine blade applications.

Because of the tendency for some interdiffusion during deposition processes and heat treatments used to form the coating 24 (evidenced in part by the presence of a diffusion zone 30 beneath the coating 24 in FIG. 2), the coating 24 may contain up to about 20 weight percent of elements that were not deposited with the intentional coating constituents. Elements such as nickel, tantalum, tungsten, rhenium, aluminum, molybdenum, cobalt, chromium, etc., are often present in superalloy compositions and tend to readily diffuse at the high temperatures often associated with coating processes and encountered by superalloy components. The diffusion zone 30 associated with the coating 24 of this invention tends to be free of low melting point regions typically present and detrimental to traditional aluminum-based environmental coatings and bond coats because of the high melting temperatures of the predominant constituents of the coating 24. To inhibit interdiffusion and thereby better control the composition of the coating 24, a diffusion barrier coating may be deposited on the substrate 22 before depositing the coating 24. Examples of particularly suitable diffusion barrier coatings are ruthenium-containing coatings disclosed in commonly-assigned U.S. Pat. Nos. 6,306,524, 6,720,088, 6,746,782, 6,921,586, and 6,933,052.

To help illustrate the benefits of the present invention, the following is intended to contrast the different results obtained with traditional environmental coatings and the coating 24 of this invention. For this purpose, a thickness of about 500 micrometers will be assumed for the wall, protected by a coating (environmental or bond coat) having a thickness of about 125 micrometers. Such a wall-to-coating proportion is represented in FIG. 2. In a first scenario, the coating is a traditional bond coat material such as MCrAlY or PtAl and has a strength of about 20% of the superalloy that forms the wall. As a result, the combination of the wall and coating has an initial combined strength of (100%×500+20%×125)/(500+125)=84% of the strength that would have been obtained if the entire wall+coating thickness had been formed of the superalloy. Following loss of the coating due to oxidation, the original combination of wall and coating would be reduced to only the wall, and therefore a relative strength of 80%.

In a first example in which the coating is a coating 24 of the present invention having a strength of about 60% of the superalloy that forms the wall (22), the combination of the wall and the coating would have a combined relative strength of (100%×500+60%×125)/(500+125)=92% of the strength that would have been obtained if the entire wall+coating thickness had been formed of the superalloy. Because the oxidation and corrosion resistance of preferred coating materials of this invention reduces losses to the thickness of the coating to very low or negligible levels, the combination of wall and coating substantially retains its original strength.

In a second example corresponding to the present invention, the coating has a strength of 100% of the superalloy that forms the wall, in which case the combination of the wall and coating would have a combined strength relative to the superalloy of 100%. Again, degradation of the combined strength of the wall and coating is minimal due to the oxidation and corrosion resistance of the preferred coating materials of this invention.

From the above analysis, it can be seen that the thickness of the wall 22 could be reduced yet still achieve combined wall+coating strengths of equal to or greater than that possible with traditional environmental coating and bond coat materials. As a result, if desired the coatings 24 of this invention can be deposited to greater thicknesses in proportion to the walls they protect, e.g., more than 25% of the wall thickness in the above examples. Alternatively, thinner walled parts can be utilized, saving material cost and weight.

While the invention has been described in terms of a preferred embodiment, it is apparent that other forms could be adopted by one skilled in the art. Accordingly, the scope of the invention is to be limited only by the following claims.

What is claimed is:

1. A coating system on a substrate formed of a superalloy material, the coating system comprising an environmentally-protective coating on and contacting a surface of the substrate and formed of a coating material having a tensile strength of more than 50% of the superalloy material at a temperature within a temperature range of about 900° C. to about 1150° C., the coating material being predominantly at least one metal chosen from the group consisting of platinum, rhodium, palladium, and iridium.

2. The coating system according to claim 1, wherein the coating material further contains at least one of zirconium, hafnium, tantalum, titanium, niobium, chromium, tungsten, molybdenum, rhenium, and ruthenium.

3. The coating system according to claim 1, wherein the coating material further contains at least one of aluminum, chromium, and nickel.

4. The coating system according to claim 1, wherein the coating material consists of, by weight, at least 60% of platinum, rhodium, palladium, iridium, or a combination thereof, at least 5% but not more than 20% of nickel and chromium in combination, at least 2% but not more than 15% aluminum, and at least 2% but not more than 10% of titanium, zirconium, hafnium, tantalum, niobium, tungsten, molybdenum, rhenium, and ruthenium in combination.

5. The coating system according to claim 1, wherein the coating material consists essentially of rhodium, zirconium, and at least one of platinum, ruthenium, and palladium.

6. The coating system according to claim 1, wherein the coating material consists essentially of about 60 weight percent rhodium, about 25 weight percent palladium, about 10 weight percent platinum, and about 3 weight percent zirconium.

7. The coating system according to claim 1, wherein the coating material consists essentially of about 91 weight percent rhodium, about 2 weight percent ruthenium, and about 7 weight percent zirconium.

8. The coating system according to claim 1, wherein the coating material has a tensile strength of at least 160 MPa at about 1200° C.

9. The coating system according to claim 1, wherein the coating material has a tensile strength of at least 260 MPa at about 1200° C.

10. The coating system according to claim 1, wherein the tensile strength of the coating material is at least 60% of the tensile strength of the superalloy material at a temperature within a temperature range of about 900° C. to about 1150° C.

11. The coating system according to claim 1, wherein the tensile strength of the coating material is at least 80% of the tensile strength of the superalloy material at a temperature within a temperature range of about 1000° C. to about 1150° C.

12. The coating system according to claim 1, wherein the environmentally-protective coating has a thickness of about 25 to about 125 micrometers.

13. The coating system according to claim 1, wherein the environmentally-protective coating has a thickness of at least 35 micrometers.

14. The coating system according to claim 1, further comprising a diffusion barrier layer between the environmentally-protective coating and the substrate.

15. The coating system according to claim 1, further comprising a thermal-insulating ceramic layer adhered to the environmentally-protective coating.

16. The coating system according to claim 1, wherein an oxide layer is substantially absent between the environmentally-protective coating and the ceramic layer.

17. The coating system according to claim 1, wherein the substrate is an airfoil component of a gas turbine engine.

18. The coating system according to claim 1, wherein the substrate is a rotating airfoil component of a gas turbine engine.

19. A coating system on a wall of a rotating gas turbine engine airfoil component formed of a superalloy material, the coating system comprising an environmentally-protective coating on and contacting a surface of the wall and formed of a coating material having a tensile strength of more than 50% of the superalloy material at a temperature within a temperature range of about 900° C. to about 1150° C., the coating material consisting of, by weight, at least 60% of platinum, rhodium, palladium, iridium, or a combination thereof, optionally at least 5% but not more than 20% of nickel and chromium in combination, optionally at least 2% but not more than 15% aluminum, and optionally at least 2% but not more than 10% of titanium, zirconium, hafnium, tantalum, niobium, tungsten, molybdenum, rhenium, and ruthenium in combination.

20. The coating system according to claim 19, wherein the coating material has a tensile strength of at least 160 MPa at about 1200° C.

* * * * *